US007657047B2

(12) United States Patent
Fischer

(10) Patent No.: US 7,657,047 B2
(45) Date of Patent: Feb. 2, 2010

(54) HEARING AID WITH INFORMATION SIGNALING

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 792 days.

(21) Appl. No.: 11/194,933

(22) Filed: Aug. 2, 2005

(65) Prior Publication Data

US 2006/0023905 A1 Feb. 2, 2006

(30) Foreign Application Priority Data

Aug. 2, 2004 (DE) ..... 10 2004 037 376

(51) Int. Cl.
*H04R 25/00* (2006.01)

(52) U.S. Cl. ..... 381/314; 381/312; 381/315

(58) Field of Classification Search ..... 381/314, 381/315, 312, 321, 317
See application file for complete search history.

(56) References Cited

U.S. PATENT DOCUMENTS

| | | | | |
|---|---|---|---|---|
| 4,425,481 | A * | 1/1984 | Mansgold et al. | 381/317 |
| 4,689,820 | A * | 8/1987 | Kopke et al. | 381/315 |
| 4,777,474 | A * | 10/1988 | Clayton | 340/539.11 |
| 5,524,150 | A | 6/1996 | Sauer | |
| 6,704,424 | B2 | 3/2004 | Killion | |
| 7,149,319 | B2 * | 12/2006 | Roeck | 381/314 |
| 2002/0021714 | A1 | 2/2002 | Seguin | |
| 2005/0111680 | A1 | 5/2005 | Meier et al. | |

FOREIGN PATENT DOCUMENTS

| | | | |
|---|---|---|---|
| DE | 26 40 012 | A1 | 3/1978 |
| DE | 32 05 686 | C2 | 8/1983 |
| DE | 32 07 412 | A1 | 9/1983 |
| DE | 41 04 359 | C2 | 8/1992 |
| DE | 42 06 084 | C1 | 12/1992 |
| DE | 42 17 629 | A1 | 12/1993 |
| DE | 100 47 548 | A1 | 4/2002 |
| DE | 101 62 802 | A1 | 7/2003 |
| EP | 0 557 847 | B1 | 9/1993 |
| EP | 0 996 244 | A2 | 4/2000 |
| EP | 1 387 175 | A1 | 2/2004 |
| EP | 1420611 | A1 | 5/2004 |
| WO | WO 01/30127 | A2 | 3/2001 |

* cited by examiner

*Primary Examiner*—Suhan Ni
*Assistant Examiner*—Jasmine Pritchard

(57) ABSTRACT

The emission of information signals for informing a user about specific settings or statuses of a hearing aid should be improved. In addition, it is proposed to offer the user a plurality of different information signals which he can freely assign to different settings and or statuses of the hearing aid. In addition, different information signals are emitted as a function of the currently available hearing situation and/or the currently set hearing program for one and the same setting and/or for one and the same status of the hearing aid. The user is thus able to better identify the information signals.

8 Claims, 1 Drawing Sheet

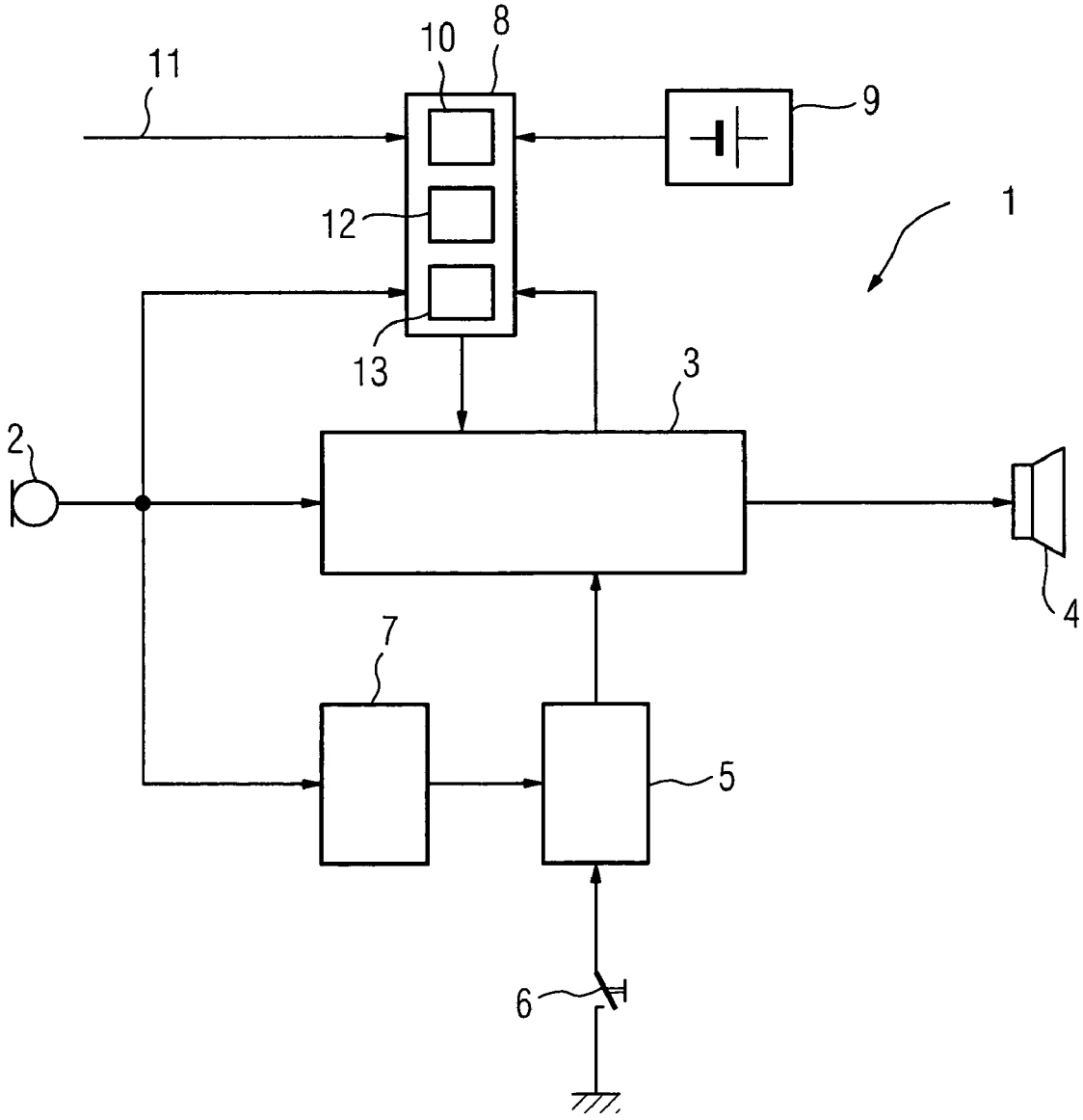
11
10
8
9
12
1
13
3
2
4
7
5
6

HEARING AID WITH INFORMATION SIGNALING

CROSS REFERENCE TO RELATED APPLICATIONS

This application claims priority to the German application No. 10 2004 037 376.0, filed Aug. 2, 2004 which is incorporated by reference herein in its entirety.

FIELD OF INVENTION

The invention relates to a hearing aid with an input converter for receiving an input signal, a signal processing unit and an output converter for emitting an output signal which can be perceived by the user as an acoustic signal, with the user b eing informed of settings or statuses of the hearing aid by means of different output signals that are stored or generated in the hearing aid. The invention further relates to a method for operating a hearing aid of this type.

BACKGROUND OF INVENTION

EP 0 557 847 B1 discloses a hearing aid which can be worn on the head, comprising an electrical signal path between a microphone and a receiver, with the signal path able to be adapted to different hearing situations/acoustic environments using means for electronically setting preprogrammable transmission parameters, and a switching means of the hearing aid, with the switching means additionally controlling a signal emission device which emits at least one signal which is characteristic for the transmission parameter set for a specific hearing situation/acoustic environment in each instance, with the hearing aid user being able to perceive this signal and to be informed of the selected setting without removing the hearing aid from their head. The signals emitted by the known hearing aid are successive tones or voice signals generated or stored in the hearing aid.

SUMMARY OF INVENTION

An object of the present invention is to allow a more flexible use of acoustic signals to display settings or statuses of the hearing aid.

This object is achieved with a hearing aid with an input converter for receiving an input signal, a signal processing unit and an output converter for emitting an output signal which can be perceived by the user as an acoustic signal, with the user being informed of settings or statuses of the hearing aid by means of different information signals that are stored or generated in the hearing aid such that one and the same setting and/or one and the same status can be assigned acoustic information signals of different categories.

The object is further achieved by means of a method for operating a hearing aid with an input converter for receiving an input signal, a signal processing unit and an output converter for emitting an output signal which can be perceived by the user as an acoustic signal, with the user being informed of settings or statuses of the hearing aid (1) by means of different information signals that are stored or generated in the hearing aid and with which the signal processing in the hearing aid is adapted to different hearing situations by means of the following steps:

Assigning acoustic information signals of different categories to a setting and/or a status of the hearing aid Emitting an acoustic information signal to inform the user about the setting and/or the status with the category of the acoustic information signal dependent on the hearing situation.

An input signal is received in a hearing aid by means of an input converter and converted into an electrical input signal. Typically at least one micro phone receiving an acoustic signal serves as an input converter. Modern hearing aids frequently have a microphone system with several microphones in order to obtain reception which is a function of the incident direction of acoustic signals, a directional characteristic. The input converters can however also comprise a telephone coil or an antenna to receive electromagnetic input signals. The input signals converted to electrical signals by means of the input converter are fed to a signal processing unit for further processing and amplification. To compensate for the individual hearing loss of a hearing aid wearer, further processing and amplification generally take place as a function of the signal frequency. The signal processing unit emits an electrical output signal, which is fed to the ear of the hearing aid wearer via an output converter, so that said wearer perceives the output signal as an acoustic signal. Receivers that generate an acoustic output signal are typically used as output converters. Output converters for generating mechanical vibrations are however also known, which directly cause specific parts of the ear to vibrate, the ossicles for instance. Output converters are also known which directly stimulate the nerve cells of the ear.

Modern hearing aids can be adapted to different hearing surroundings by means of different settings in the form of changeable parameters which influence the signal processing in the hearing aid. Hearing situations of this type are for example "quiet surroundings", "television", "conversations in disturbance noise", "reception by means of telephone coils" etc. A parameter set to adapt the signal processing to a specific hearing situation is usually referred to as a hearing program. Hearing programs in the respective hearing situation can be manually set by means of the user. Furthermore, modern hearing aids have a classifier to automatically identify the current hearing situation and an automatic adjustment of the signal processing in the hearing aid associated therewith, to the relevant hearing situation. A user is frequently interested to know how his/her hearing aid is currently set in order to be able to monitor the current settings and if necessary to implement the changes of these settings. By way of example, a hearing aid wearer would like to know whether the actual hearing situation was identified correctly by the classifier. Other settings relate for example to specific filters or algorithms which could be switched-on or switched-off. In addition to the settings, specific statuses of his/her hearing aid are also of interest to the user, of which he would like to be informed. Statuses of this type relate for instance to the current charge status of a power source used. Further examples of settings, of which the user would like to be informed if necessary, relate to the current setting of a volume actuator, settings relating to the increase of reduction of specific frequency ranges or the use of specific sound control openings.

According to the invention, with a hearing aid, one and the same setting, e.g. hearing program 1 and/or one and the same state, e.g. fully charged power source, acoustic information signals of different categories can be set to inform the user of this setting and/or this status. Different signals are thus principally understood in terms of acoustic information signals of different categories, said different signals differing by the very difference in terms of the volume or slight sound displacements as a result of different signal processing in the hearing aid. Examples for acoustic information signals of different categories are: voice, music (melodies, melodic sound sequences etc), single tones, non melodic tone sequences, noises etc. The different information signals for one and the same setting and/or one and the same status are to be correspondingly fundamentally distinguished, by way of example in that on the one hand currently set hearing programs are displayed by means of a specific number of beeping tones and on the other hand by voice outputs. In this way, the hearing aid according to the invention can be adjusted to the desires and requirements of a user in terms of the information signals used. The information signals can be selected such that mistakes between the different information signals assigned to the settings or statuses can be ruled out as far as possible.

One embodiment of the invention provides for a library of information signals, so that the user can freely assign signals from this library to individual settings and statuses. The assignment can be determined for example by programming the hearing aid.

Another embodiment of the invention provides a memory area in the hearing aid, in which the user can save his/her own information signals and can assign specific settings or statuses. By way of example, the user can receive and store an acoustic signal by way of a microphone in the hearing aid and assign it to a specific setting or a specific status. The use of a signal generator allows information signals to be synthesized in the hearing aid, in addition to the information signals stored permanently in the hearing aid and recallable if necessary.

In a preferred embodiment of the invention, several acoustic information signals which belong to different categories can be assigned to a setting and/or a status of the relevant hearing aid. Advantageously information signals of the different categories are automatically emitted to display one and the same setting and/or to display one and the same status of the hearing aid, as a function of the current hearing situation. By way of example, in the hearing situation 'voice', the information signals are emitted in the form of sounds which are dissimilar to the voice. In contrast, in the situation 'music' the user is informed in the form of voice signals. In general, the information signals are correspondingly selected as a function of the current hearing situation, such that these can be perceived by the user in the current hearing situation in the best possible manner. The currently set hearing program behaves in a similar manner to the current hearing situation. If the hearing program 'voice' is set for instance, the information signals are presented in the form of sounds which are dissimilar to the voice. Furthermore, a hearing aid according to the invention can also be set such that specific information signals are principally only emitted with the identified hearing situation and/or the set hearing program for 'quiet surroundings'. Nevertheless, this setting allows specific information signals such as the warning about a discharged power source to be received.

BRIEF DESCRIPTION OF THE DRAWINGS

The FIGURE depicts a preferred embodiment of the invention.

DETAILED DESCRIPTION OF INVENTION

The invention is described in more detail below with reference to an exemplary embodiment. For the description the FIGURE shows a hearing aid 1 with a microphone 2 to receive an acoustic input signal and to convert said input signal into an electrical input signal. The latter is fed to a signal processing unit 3 for further processing and frequency-dependent amplification. This in turn emits an electrical output signal, which is converted into an acoustic signal by means of a receiver 4 and is fed to the ear of a hearing aid wearer. The hearing aid 1 further comprises a program memory 5 for storing several parameter sets, so called hearing programs, among which one is switched to active and currently influences the signal processing in the signal processing unit 3. Different active hearing programs can be switched between by means of the manual activation of a push button 6. Furthermore, the hearing aid 1 comprises a classifier 7 which analyses the electrical input signal and thereby automatically identifies the current hearing situation. During the normal operation of the hearing aid 1, the active hearing program is thus automatically determined from the program memory 5 by means of the classifier 7.

The hearing aid 1 according to the invention comprises means to output acoustic information signals which inform the user of current settings such as the current hearing program, current switched-on or switched-off filters or signal processing algorithms of the signal processing unit 3 for instance. Furthermore, the user is also informed of specific statuses of the hearing aid, such as the charge status of the power source 9 for instance. The means 8 for generating an information signal comprise a memory 10 for storing information signals, which were transmitted from the outside to the hearing aid 1. These can be recorded for example by means of the microphone 2. Furthermore, an electrical signal path 11 is also provided, by means of which information signals can be read into the memory 10 by means of an electrical connection with another device (not shown). Furthermore, the means 8 for generating an information signal also comprise a signal generator 12, by means of which information signals can be directly generated in the hearing aid.

According to the invention, with the hearing aid 1 for informing about one and the same setting, e.g. hearing program 1 is active, different acoustic information signals can be selected to inform the user about this setting. Thus the acoustic voice signal 'hearing program' or a one-off beeping tone to inform the user of the hearing program 1 is emitted. The assignment takes place according to the preferences of the user, e.g. via the electrical signal path 11 with the programming of the hearing aid 1. To offer a user the most extensive selection of information signals possible, which can then be assigned to different settings and statuses according to taste, the means 8 for generating an information signal comprise an information signal library 13, so that the user can choose from a plurality of different predetermined information signals. The selection also takes place in this case by programming the hearing aid via the electrical signal path 11 for example.

In contrast to the exemplary embodiment displayed, the information signal library can also be stored externally to the hearing aid, for example on a computer which can be connected to the hearing aid 1. Information signals selected by the user can then also be transmitted by the computer into the memory 10 and stored therein.

In the particularly preferred embodiment of the invention according to the exemplary embodiment, provision is made that the settings or statuses of the hearing aid 1 are not only permanently assigned one acoustic information in each instance, but that at least one setting and/or status is assigned a number of acoustic information signals which are stored or generated in the hearing aid, in which the acoustic information signals assigned to a setting or a status are associated with different categories of acoustic signals. The emission of an acoustic information signal in terms of a specific setting or a specific status then takes place as a function of the current settings of the signal processing unit 3 and in particular as a function of the currently active hearing program. Advantageously with a hearing program for voice, no voice signals are output to inform the user for example. Instead, easily distinguishable tones or sounds are selected by voice. In contrast, in a hearing program for music, voice signals for informing the user are preferably selected.

In the hearing aid 1 according to the exemplary embodiment, provision is further made that information about rather unimportant settings and/or statuses, e.g. the information about the current hearing program, is principally only emitted in a hearing program for quiet surroundings. Only information which is essentially important to the user is emitted in all hearing programs, e.g. a warning of a discharged power source 9.

The invention is advantageous in that a user can assign different information signals to specific settings and statutes according to personal taste, said information signals being particularly pleasant for him or in which the information concealed therein can be easily identified. The situation-dependent emission of very different information signals to inform of one and the same setting and/or one and the same status additionally contributes to allowing the user to identify the information in the relevant situation in the best possible manner.

The invention claimed is:

1. A hearing aid, comprising:

an input converter for receiving an input signal;

a signal processing unit; and an output converter for emitting an acoustic output signal perceivable by a user of the hearing aid, wherein the user is informed about a setting or a status of the hearing aid using a plurality of acoustic information signals grouped into categories related to the setting or the status respectively, the acoustic information signals are stored in a memory unit of the hearing aid or are generated within the hearing aid, the hearing aid is adapted for free signaling configuration such that the user can select at least one information signal from the plurality of acoustic information signals and assign the selected acoustic information signal to at least one setting or status so that a future occurrence of the at least one setting or status while operating the hearing aid triggers the output converter to output the at least one selected acoustic information signal, and wherein the output converter is adapted to only emit the acoustic information signals if an identified hearing situation or the set hearing program is operated for a quiet acoustic environment.

2. The hearing aid according to claim 1, further comprising a library for storing the plurality of acoustic information signals, and a selection interface for selecting the at least one selected acoustic information signal from the library and for assigning the selected acoustic information signal to the at least one setting or status.

3. The hearing aid according to claim 1, wherein the memory unit is configured to store acoustic signals generated outside the hearing aid, and the acoustic signals generated outside the hearing aid are included in the selected acoustic information signals.

4. The hearing aid according to claim 1, wherein a number of the acoustic information signals belonging to different categories are simultaneously assigned to one setting or one status of the hearing aid, and the output converter is configured to emit the information signals belonging to the different categories if a current hearing situation corresponds to the one setting or status.

5. The hearing aid according to claim 4, further comprising a classification device for automatically identifying the current hearing situation, wherein the classification device is configured to adjust at least one signal processing parameter included in the signal processing unit based on the current hearing situation.

6. The hearing aid according to one claim 1, further comprising a plurality of hearing programs selectable by the user for adjusting at least one signal processing parameter included in the signal processing unit, wherein at least one of the acoustic information signals is assigned to each hearing program, and at least one of the categories is assigned to each hearing program.

7. The hearing aid according to claim 4, wherein the hearing aid is configured to automatically select at least one of the information signals which is not a speech signal for identifying the current hearing situation, if the current hearing situation is related to speech.

8. A method for operating a hearing aid having an input converter for receiving an input signal, a signal processing unit, and an output converter for emitting an acoustic output signal perceivable by a user of the hearing aid, wherein the user is informed about a settings or a status of the hearing aid by a plurality of acoustic information signals grouped into different categories associated with a number of hearing situations and stored in or generated by the hearing aid, and the hearing aid is configured to be adjusted to different hearing situations by adjusting at least one signal processing parameter included in the signal processing, the method comprising:

assigning at least two acoustic information signals belonging to different categories to one setting or one status of the hearing aid; and emitting at least one acoustic information signal for informing the user about the setting or the status, the emitted acoustic information signal having a category associated with a current hearing situation, wherein emission of the acoustic information signal only takes place if a current hearing situation is identified as a quiet hearing situation or if operation of the hearing aid is in a quiet acoustic environment program.

* * * * *

UNITED STATES PATENT AND TRADEMARK OFFICE

CERTIFICATE OF CORRECTION

PATENT NO. : 7,657,047 B2
APPLICATION NO. : 11/194933
DATED : February 2, 2010
INVENTOR(S) : Eghart Fischer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1219 days.

Signed and Sealed this

Thirtieth Day of November, 2010

David J. Kappos

David J. Kappos
*Director of the United States Patent and Trademark Office*